United States Patent [19]

Yamamoto et al.

[11] 4,308,335

[45] Dec. 29, 1981

[54] COLOR DIFFUSION TRANSFER PHOTOGRAPHIC ELEMENTS

[75] Inventors: Tatsuya Yamamoto, Odawara; Kazunobu Katoh, Minami-ashigara, both of Japan

[73] Assignee: Fuji Photo Film Co., Ltd., Minami-ashigara, Japan

[21] Appl. No.: 170,391

[22] Filed: Jul. 21, 1980

[30] Foreign Application Priority Data

Jul. 20, 1979 [JP] Japan ..... 54/92274

[51] Int. Cl.[3] ..... G03C 5/54; G03C 7/00; G03C 1/40

[52] U.S. Cl. ..... 430/213; 430/941; 525/902; 525/916; 428/515

[58] Field of Search ..... 430/213, 238, 518, 627, 430/630, 941; 525/902, 916; 101/464; 428/515; 8/467

[56] References Cited

U.S. PATENT DOCUMENTS 3,898,088 8/1975 Cohen et al. ..... 430/518

3,958,995 5/1976 Campbell et al. ..... 430/518

*Primary Examiner*—Richard L. Schilling

*Attorney, Agent, or Firm*—Sughrue, Mion, Zinn, Macpeak & Seas

[57] ABSTRACT

A mordant layer for a color diffusion transfer photographic element containing a cationic polymer latex obtained by emulsion-polymerizing a monomer represented by formula (I)

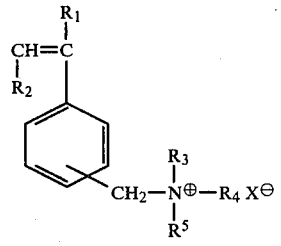

(I)

wherein $R_1$ and $R_2$ each represents hydrogen or an alkyl group having from 1 to 6 carbon atoms; $R_3$, $R_4$, and $R_5$ each can represent an alkyl group having from 1 to 20 carbon atoms, or an aralkyl group having from 7 to 10 carbon atoms, or any two or $R_3$, $R_4$, and $R_5$ together can form a ring; and $X^{\ominus}$ represents an anion; as a shell component for a core component of dispersed particles of a polymer latex obtained by emulsion-polymerizing a water-insoluble monomer or monomers other than the monomer of formula (I).

28 Claims, No Drawings

COLOR DIFFUSION TRANSFER PHOTOGRAPHIC ELEMENTS

BACKGROUND OF THE INVENTION

1. Field of the Invention

This invention relates to color diffusion transfer photographic elements and, in particular, to color diffusion transfer photographic elements having a mordant layer for forming color images, said layer containing a seed polymerized cation latex.

2. Description of the Prior Art

It is well known to use a variety of polymer materials as mordants for preventing the transfer of dyes in the field of photographic techniques. It is also known that a polymer having a quaternary nitrogen atom is useful as a mordant for dyes having a group providing an anion by dissociation, such as a sulfonic acid group, a sulfonamido group, etc., particularly when used as mordants for forming color images.

When a polymer is used as a mordant for forming color images, it is necessary for maintaining high image density to prevent dyes from escaping or diffusing from a mordant layer to other layers, and for this purpose, a polymer having excellent mordanting properties is required. Thus, polymer mordants having properties of receiving dyes and strongly holding images formed have been widely investigated, and it has been clarified in U.S. Pat. No. 3,898,088 to be desirable (for having excellent mordanting properties for dyes) that the polymer mordant be insoluble in water and have the recurring unit represented by formula (II)

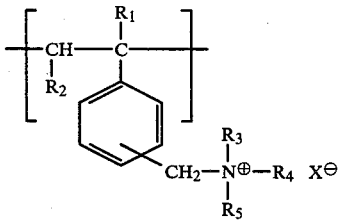

(II)

wherein $R_1$ and $R_2$ each represents hydrogen or an alkyl group having from 1 to 6 carbon atoms; $R_3$, $R_4$, and $R_5$ each can represent an alkyl group having from 1 to about 20 carbon atoms; and $X^{\ominus}$ represents an anion; said polymer mordant being insoluble in water by controlling: (a) the total carbon numbers of $R_3$, $R_4$, and $R_5$; (b) the amount of an ethylenically unsaturated comonomer, if any; and (c) combinations of (a) and (b).

When a polymer mordant shown by formula (II) is insoluble in water, steps for dissolving the polymer mordant in an organic solvent and then coating the organic solvent solution are necessary for incorporating the polymer in photographic elements. However, in the case of coating such a solution of the polymer mordant in an organic solvent, various difficulties are encountered, as described below, and hence it is difficult to produce stable photographic elements. Such difficulties include:

(1) Explosion-proof coating equipment may be required by law.

(2) The application of the organic solvent solution onto other photographic layers (e.g., a silver halide emulsion layer) for forming multilayer elements is very difficult.

(3) The selection of an effective hardening agent for the layer is greatly restricted.

(4) It is difficult to incorporate a light-fading prevention agent therein to prevent fading of transferred dyes.

In order to overcome such difficulties, it is preferred that the solvent for coating compositions be an aqueous medium.

As a technique for coating a water-insoluble polymer in an aqueous system, a method is known wherein the polymer is coated as an aqueous latex thereof. It is, however, difficult to prepare a polymer cation latex having excellent mordanting properties by conventional methods. That is, for preparing a polymer latex from a water-insoluble monomer represented by formula (I) below, containing a quaternary nitrogen atom, a method is of emulsion-polymerizing the water-insoluble monomer using a water-soluble polymerization initiator in the presence of a cationic surface active agent and/or a nonionic surface active agent, or in the presence of a water-soluble polymer such as polyvinyl alcohol, gelatin, etc., or in the presence of such a water-soluble polymer and the above-described surface active agent(s). Monomers according to formula (I) are represented by

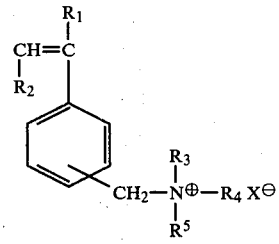

(I)

wherein $R_1$ and $R_2$ each represents hydrogen or an alkyl group having from 1 to 6 carbon atoms; $R_3$, $R_4$, and $R_5$ each can represent an alkyl group having from 1 to 20 carbon atoms, an aralkyl group having from 7 to 10 carbon atoms, or any two of $R_3$, $R_4$, and $R_5$ together can form a ring; and $X^{\ominus}$ represents an anion. The aralkyl group can be substituted by a halogen atom or a nitro group.

The monomer employed in such an emulsion polymerization can be:

(i) a monomer of formula (I) alone, or (ii) a mixture of a monomer of formula (I) and at least one vinylic monomer other than that of formula (I) which are to be copolymerized (in this case, it is preferred that the vinylic monomer other than that of formula (I) be insoluble in water).

When the polymer latex is to be used as a mordant, it is desirable that the content of quaternary nitrogen atoms per the unit weight of the polymer be as high as possible. From this viewpoint, the use of a monomer of formula (I) alone, as in item (i) above, is most preferable, but in this case it is very difficult to select conditions for preparing a stable polymer latex of fine particles which have a polymer concentration of higher than 5% by weight (which is reuired in practical use) without forming coagulates of the polymer latex and which is capable of providing coatings having a transparency sufficient for practical use. Thus, no totally practical method is known in the art for producing a polymer latex.

In the case of using a mixture of a monomer of formula (I) and at least one vinyl monomer other than that of formula (I) which are to be copolymerized, as in item (ii) above, the conditions for producing a stable polymer latex without coagulation of the polymer may be relatively easily selected, but when the proportion of the monomer of formula (I) in the copolymer is in the range of from 50 to 99 mol%, which is preferable for a mordant, the mean particle size of the polymer latex formed becomes large, thereby greatly reducing the transparency of coatings formed therefrom. The tendency of increasing the mean particle size is increased dramatically as the proportion of the monomer of formula (I) nears 100%, which is a particular drawback of the method.

It is, furthermore, difficult to prevent the formation of a low molecular weight oligomer (degree of polymerization of from 2 to 10) in the copolymer latex wherein the composition ratio of the monomer of formula (I) is in the range of from 10 to 95 mol%. In a color diffusion transfer system, the intermixing of such low molecular weight components (including monomers, oligomers, etc.) is undesirable, since these low molecular weight components leave a mordant layer composed of gelatin and a polymer mordant and diffuse from the layer into an adjacent white reflecting layer or other layer and they capture dyes diffused therein from photosensitive silver halide emulsion layers, whereby the amount of dyes reaching the mordant layer is reduced to greatly deteriorate the density of dye images formed.

Other methods of producing cationic high molecular latexes for photography are described in Japanese Patent Application (OPI) Nos. 73440/76 and 45231/78 (the term "OPI" as used herein refers to a "published unexamined Japanese patent application"), but these methods have drawbacks as described below. That is, in the methods disclosed in Japanese Patent Application (OPI) Nos. 73440/76 and 45231/78, a polymer latex is prepared using a vinylic monomer having a group causing a reaction with a tertiary amine to form a quaternary nitrogen atom, such as, for example, vinylbenzyl chloride, and thereafter the polymer latex is reacted with a tertiary amine using an auxiliary solvent, to provide a cationic polymer latex. More specifically, the cationic polymer latex is produced in these methods by the polymerization of a monomer shown by formula (III)

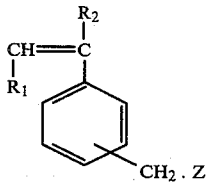

(III)

wherein $R_1$ and $R_2$ each represents hydrogen or an alkyl group having from 1 to 6 carbon atoms and Z represents a halogen atom, and the subsequent quaternarization reaction with a tertiary amine shown by the formula (IV)

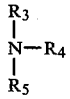

(IV)

wherein $R_3$, $R_4$ and $R_5$ each represents an alkyl group having from 1 to 20 carbon atoms, an aralkyl group having from 7 to 10 carbon atoms (wherein the aralkyl group can have a halogen atom or a nitro group as a substituent); or said $R_3$, $R_4$ and $R_5$ may combine with each other to form a ring.

However, in these methods a cationic polymer latex can be relatively easily prepared only when the tertiary amine has a relatively short alkyl chain, but resulting cationic polymer latex does not provide good mordanting properties. In other cases, when a tertiary amine of formula (IV) having a long alkyl chain (e.g., trihexylamine, etc.) is used in order that the resulting cationic polymer latex is insoluble in water (i.e., to provide superior mordanting properties), the methods described above encounter the following drawbacks:

First, when a water-insoluble tertiary amine is used, the quaternarization reaction does not proceed and the latex forms coagulates.

Second, for reacting a tertiary amine which is reluctant to cause quaternarization reaction, with a polymer, a method must be employed in which an auxiliary organic solvent (e.g., methanol, etc.) capable of dissolving the tertiary amine and being miscible with water is used, but in this case it is very difficult to find an auxiliary organic solvent fitting the purposes without having adverse influences on the stability for dispersion of a percursor latex (i.e., polymer latex formed from the monomer of formula (III)).

Third, the reaction of the tertiary amine and a polymer is essentially a macromolecular reaction, and hence even if conditions for reacting these reactants are found, it is still impossible to reach the theoretical 100% reaction. In particular, when a tertiary amine having a long alky chain is used, the reaction is not favored, and it is impossible to react more than about 80% of the halomethyl group, which results in difficulty in obtaining a cationic polymer latex having excellent mordanting properties.

Fourth, when a large amount of tertiary amine is added to increase the efficiency of the quaternarization, the tertiary amine remaining in the polymer latex formed adversely affects the stability for the dispersion of the polymer latex, and when such a polymer latex is used for photographic elements, it can cause fogging of silver halide emulsions.

Fifth, the halomethyl group remaining in the polymer latex formed has a very high reactivity, and the presence of such a group not only reduces the stability of the polymer latex by the occurrence of cross-linking, but also causes a hydrolysis to release hydrochloric acid, which makes it difficult to control the pH of the polymer latex. Furthermore, when the polymer latex is used as a mordant for photography, the presence of the halomethyl group causes a reduction in image density, an increase in stain, and so forth.

SUMMARY OF THE INVENTION

A first object of this invention is to provide diffusion transfer photographic elements using polymer mordants which can be coated using an aqueous solvent.

A second object of this invention is to provide a method for producing a stable polymer latex mordant of fine particles (smaller than 0.1 micron in mean particle size) containing substantially no diffusible low molecular weight components.

A third object of this invention is to provide novel photographic elements containing polymer latex mordants having a property of firmly holding dyes for photography.

A fourth object of this invention is to provide color diffusion transfer photographic elements comprising a layer containing a fine particulate stable polymer latex mordant having a strong mordanting power (and containing substantially no low molecular weight components), silver halide emulsion layers, and a support.

A fifth object of this invention is to provide a laminated integral type color diffusion transfer photographic element having silver halide emulsion layers having associated therewith dye image-providing materials and a layer containing a fine particulate and stable polymer latex mordant having a strong mordanting power and containing no low molecular weight components.

As a result of extensive investigations, the inventors have discovered that the aforementioned objects of this invention can, surprisingly, be achieved, by using a cationic polymer latex which is prepared by the emulsion polymerization of a water-insoluble monomer containing a quaternary nitrogen atom represented by formula (I) (shown below) employing a so-called seed polymerization, i.e., by emulsion-polymerizing the monomer of formula (I) as an outer shell component for a core component of dispersed particles of a polymer latex formed by an emulsion polymerization of at least one kind of a water-insoluble monomer other than that of formula (I). The monomer of formula (I) is represented by

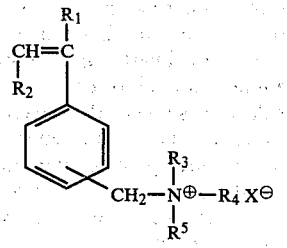

(I)

wherein $R_1$ and $R_2$ each represents hydrogen or an alkyl group having from 1 to 6 carbon atoms (e.g., a methyl group, ethyl group, propyl group, butyl group, etc.); $R_3$, $R_4$, and $R_5$ each can represent an alkyl group having from 1 to 20 carbon atoms (e.g., a methyl group, ethyl group, propyl group, butyl group, pentyl group, hexyl group, octyl group, dodecyl group, etc.), an aralkyl group having from 7 to 10, and preferably 7 or 8 carbon atoms (e.g., a benzyl group), and including halogen-substituted (e.g., a p-chlorobenzyl group) and nitro-substituted aralkyl groups; or any two of $R_3$, $R_4$, and $R_5$ together can form a ring, such as, for example, a piperidine ring, which may be substituted by an alkyl group having, preferably, from 1 to 5 carbon atoms; and $X^{\ominus}$ represents a cation. In the foregoing, $R_1$ and $R_2$ may be the same or different, as may $R_3$, $R_4$, and $R_5$.

DETAILED DESCRIPTION OF THE INVENTION

The monomers shown in formula (I) are water-insoluble and the water-insoluble extent of the monomer is less than 5 g of the monomer per 100 ml of water at 25° C. In order that the monomer of formula (I) be water-insoluble, it is preferred when $R_3$, $R_4$, and $R_5$ of formula (I) are an alkyl group that the sum of the carbon atoms of them be at least 12, and more preferably at least 15. Also, when at least one of $R_3$, $R_4$, and $R_5$ is an aralkyl group or the halogen- or nitro-substituted aralkyl group, it is preferred that the sum of the total carbon numbers of $R_3$, $R_4$, and $R_5$ be at least 9.

Examples of useful combinations of $R_3$, $R_4$, and $R_5$ are illustrated below:

| Monomer | $R_3$ | $R_4$ | $R_5$ |
|---|---|---|---|
| 1 | $C_6H_{13}$ | $C_6H_{13}$ | $C_6H_{13}$ |
| 2 | $C_8H_{17}$ | $C_8H_{17}$ | $C_8H_{17}$ |
| 3 | $C_2H_5$ | $C_2H_5$ | $C_{12}H_{25}$ |
| 4 | $CH_3$ | $CH_3$ | $C_{12}H_{25}$ |
| 5 | $CH_3$ | $CH_3$ | 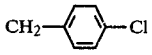 |
| 6 | $C_2H_5$ | $C_2H_5$ | 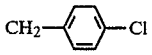 |

$X^{\ominus}$ represents a cation. Examples of useful cation are a halogen ion (e.g., chlorine ion, bromine ion, iodine ion, etc.), an alkyl sulfate ion (e.g., methyl sulfate ion, ethyl sulfate ion, etc.), an alkyl- or arylsulfonic acid ion (e.g., methanesulfonic acid ion, ethanesulfonic acid ion, benzenesulfonic acid ion, p-toluenesulfonic acid ion, etc.) an acetic acid ion, a sulfuric acid ion, and the like, but a chlorine ion is particularly preferred.

In the formula (I), position of the quaternary nitrogen atom containing group (i.e., $-CH_2-N^{\oplus}R_3R_4R_5$) is not limited but preferably at m-position or p-position with respect to the

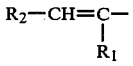

group on the benzene ring.

Preparation of emulsions by the seed polymerization method is described in detain in various publications. For example, as described in Sakae Ogata et al., *Properties and Applications of Synthetic Resin Emulsions,* Kobunshi Kanko Kai (1978), such emulsions have features such that (1) the inside of the latex particles is nonuniform, (2) fine particulate latexes can be prepared, etc. According to the seed polymerization method, the monomer of formula (I) is polymerized as an outer shell component, and hence almost all the quaternary nitrogen atoms are distributed on the surfaces of the latex particles. This is a central feature of this invention, because thereby the polymer latex of this invention shows remarkably high mordanting properties.

Examples of typical water-insoluble monomers which can form the cores of latex include ethylene, propylene, 1-butene, isobutene, 2-methylpentene, 2-methylbutene, 1,1,4,4-tetramethylbutadiene, styrene, α-methylstyrene; monoethylenically unsaturated esters of fatty acids such as vinyl acetate, isopropenyl acetate, allyl acetate, etc.; ethylenically unsaturated monocarboxylic acid or dicarboxylic acid esters such as methyl acrylate, methyl methacrylate, ethyl acrylate, diethyl methylenemalonate, etc.; monoethylenically unsaturated compounds such as acrylonitrile, allyl cyanide, etc.; and dienes such as butadiene, isoprene, and so forth.

The core component may be made of the above-described water-insoluble monomer alone, or of a copolymer of two or more such monomers. In the latter case at least one of the monomers must be the above-described water-insoluble monomer and a water-soluble monomer can be used as the comonomer. Examples of the water-soluble monomers used for the purpose are acrylamide, N-hydroxymethylacrylamide, N-methoxymethylacrylamide, N-vinylpyrrolidone, methyl vinyl ketone, acrylic acid, methacrylic acid, sodium vinylbenzenesulfonate, acrylamido-2-methylpropanesulfonic acid, N-vinylbenzyl trimethylammonium chloride, methacryloyloxyethyl trimethylammonium chloride, and the like. However, since when a monomer having an anion group is used, there is a possibility of forming coagulates of the polymer in case of the polymerization of the shell component, the amount of the monomer used must be carefully controlled.

When the water-soluble monomer is used as one of the monomers for the core component, it is preferred that the proportion thereof be lower than 5 mol% of the total of the core components.

The core component may be made of a copolymer of the above-described water-insoluble monomer and a monomer containing two or more ethylenically unsaturated groups. Examples of the monomer containing two or more ethylenically unsaturated groups include, for example, divinylbenzene, allyl acrylate, ethyleneglycol diacrylate, triethyleneglycol diacrylate, trimethylolpropane triacrylate, ethyleneglycol dimethacrylate, triethyleneglycol dimethacrylate, trimethylolpropane trimethacrylate, pentaerythritol trimethacrylate, pentaerythritol tetramethacrylate, etc.

When the monomer containing two or more ethylenically unsaturated groups is used as one of the monomers for the core component, it is preferred that the proportion thereof be lower than 30 mole% of the total of the core components.

Preferred examples of the core component are styrene, acrylic acid esters, and methacrylic acid esters, and styrene is particularly preferred.

It may be possible to copolymerize the above-described water-insoluble monomers, other than the monomer of formula (I), as the shell component, but this has drawbacks in that not only is the content of the quaternary nitrogen atom per unit weight of the polymer reduced, but also the amount of a low molecular weight oligomer in the polymer latex is increased. Accordingly, it is preferable to use the monomer of formula (I) alone as the shell component.

The ratio of the core component to the shell component of the polymer latex particles, i.e., the ratio core/shell is in the range of from 90/10 to 1/99 by mol ratio, but for obtaining a fine granulate latex (smaller than 0.1 micron in mean particle size) giving coatings having high transparency, the ratio core/shell is preferably in the range of from 55/45 to 10/90 by mol ratio, and more preferably from 25/75 to 10/90 by mol ratio.

Typical practical examples of the combinations of the core monomers and the monomers shown by formula (I) forming the shell components are illustrated below:

COMPOUND (1)

Core: n-butyl acrylate
Shell: N-vinylbenzyl trihexylammonium chloride
Core/shell ratio: 15/85 by mol ratio.

COMPOUND (2)

Core: styrene
Shell: N-vinylbenzyl trihexylammonium chloride
Core/shell ratio: 18/82 by mol ratio.

COMPOUND (3)

Core: styrene, divinylbenzene (95/5 by mol ratio)
Shell: N-vinylbenzyl trihexylammonium chloride
Core/shell ratio: 20/80 by mol ratio.

COMPOUND (4)

Core: methyl methacrylate
Shell: N-vinylbenzyl trioctylammonium chloride
Core/shell ratio: 18/82 by mol ratio.

COMPOUND (5)

Core: styrene
Shell: N-vinylbenzyl N,N-diethyl dodecylammonium chloride
Core/shell ratio: 20/80 by mol ratio.

COMPOUND (6)

Core: styrene
Shell: N-vinylbenzyl N,N-dimethyl p-chlorobenzylammonium chloride
Core/shell ratio: 17/83 by mol ratio.

Examples of surface active agents used in this invention are anionic, cationic, amphoteric, and nonionic surface active agents and they may be used solely or as a mixture of them. In case of using amphoteric and anionic surface active agents, a coagulation occurs relatively easily, and hence the use of nonionic surface active agents or cationic surface active agents is preferable. Examples of the nonionic surface active agent are, for example, polyoxyethylene alkyl ether, polyoxyethylene alkylphenyl ether, polyoxyethylene alkyl ester, sorbitan alkyl ester, polyoxyethylene sorbitan alkyl ester, etc. Examples of the cationic surface active agent are, for example, dodecyltrimethylammonium chloride, stearyltrimethylammonium chloride, N-2-ethylhexylpyridinium chloride, etc. Some of these cationic surface active agents may exert adverse influences when they are used for photographic systems, and thus nonionic surface active agents are most preferred for photographic systems. In particular, polyoxyethylene alkylphenyl ether is most preferred.

The amount of the surface active agent used in this invention is preferably from 0.1 to 10% by weight, particularly from 2 to 7% by weight, based on the total weight of the monomers, including the core component and shell component.

The surface active agent can be used together with a water-soluble polymer such as gelatin or polyvinyl alcohol as a protective colloid, and in this case the amount of the water-soluble polymer is preferably from 1 to 20% by weight to the total amount of the monomers.

In the emulsion polymerization of this invention, a radical polymerization initiator may be used, including, for example, persulfates, a redox system comprising a combination of a hydrogensulfite and a persulfate, 2,2'-azobis(2-amidinopropane) dihydrochloride, sodium azobiscyanovalerate, hydrogen peroxide, etc., but the use of 2,2'-azobis(2-amidinopropane) dihydrochloride is most preferable because it exerts less adverse influence on the polymerization properties and images, and the formation of coagulates is less.

The amount of the polymerization initiator is preferably from 0.01 to 0.5% by weight to the total amounts of the monomers included in the core component and the shell component. Also, it is preferred that the amount of the polymerization initiator used for the polymerization of the monomer of formula (I), i.e., the shell component, be from 0.05 to 0.5% by weight with respect to the amount of the monomer of formula (I). If the total amount of the polymerization initiator is less than 0.01%, the amount of remaining monomers is increased, and if the amount is larger than 0.5%, as in the case of applying the polymer latex obtained to color diffusion transfer photographic elements, the polymer latex reduces the photographic properties.

The latex employed for the core component can be prepared by ordinary methods. For example, the latexes can be advantageously prepared by the reference to the methods described in Sadao Hayashi, *Primer of Emulsions,* pages 21 to 58, Kobunshi Kanko Kai (1970); Sooich Muroi, *Chemistry of Polymer Latex,* pp 51–54, Kobunshi Kanko Kai (1976), and Takuhiko Motoyama, *Vinyl Emulsions,* pp 3–14, Kobunshi Kanko Kai (1965). However, it is desirable that the mean particle size of the core component be as small as from 0.02 to 0.08 micron and the concentration, polymerization temperature and reaction time must be selected according to the kind of the monomers. In preferred conditions, the concentration is from 0.5 to 10% by weight, the polymerization temperature is from 50° to 95° C. and the reaction period of time is from ¼ to 2 hours.

When seed-polymerizing the monomer shown by formula (I) as the shell component, it is preferred that the seed polymerization be performed after the polymerization of latex forming the core, but it is possible that a core latex is heated again to the polymerization temperature after passing over one day since the polymerization thereof to seed-polymerize the monomer of formula (I). When the seed-polymerization is performed after the polymerization of the core latex, it is preferred to start the seed polymerization at from ¼ to 2 hours after the initiation of the polymerization of the core monomer.

The monomers shown by formula (I) are usually solids and hence it it preferred that the monomer of formula (I) is supplied to the reaction system by an emulsion dropping method. An emulsion dropping method is a method wherein the monomer of formula (I) is emulsified using a surface active agent, water, and, if necessary, a polymerization initiator with stirring and the mixture in the emulsified state is added to the reaction system. The preferred polymerization temperature is from about 60° to 90° C. and the polymerization period of time including the monomer-emulsion dropping time is preferably from about 3 to 9 hours.

It is preferred that the copolymer concentration of the core component and shell component in the polymer latex be from 5 to 30% by weight. If the concentration is lower than 5% by weight, there is no practical advantage, and if the concentration is higher than 30% by weight, coagulation is liable to occur.

The mordant layer in this invention is advantageously composed of a mixture of the cationic polymer latex described above, a known hydrophilic polymer such as gelatin, polyvinyl alcohol, polyacrylamide, polyvinylpyrrolidone, etc., and a matrix polymer conventionally used for photographic materials.

As gelatin used for the mordant layer, there are lime-treated gelatin, acid-treated gelatin as well as modified gelatin, e.g., phthalated gelatin and sulfonylated gelatin. Also, as the case may be, gelatin subjected to a desalting treatment can be used.

The mixing ratio of the cationic polymer latex and the hydrophilic polymer and the coating amount of them can be easily determined by persons skilled in the art according to the amount of dyes to be mordanted, the structure of the cationic polymer latex, and the image-forming system but it is preferred that the cationic polymer/hydrophilic polymer ratio is from 20/80 to 80/20 by solid weight ratio and the coating amount of the cationic polymer is from 0.5 to 8.0 g/m$^2$.

The mordant layer in this invention may advantageously contain further various cross-linking agent, for example, an aldehyde such as formalin, glutaraldehyde, etc.; a methylol such as dimethylolurea, etc.; vinylsulfone derivatives disclosed in Japanese Patent Application (OPI) No. 76026/78, U.S. Pat. No. 3,539,644 and Japanese Patent Publication No. 13563/74; and active ester derivatives disclosed in U.S. Pat. No. 4,052,373. The amount of these cross-linking agents is selected in a wide range according to the kind thereof and the kind of the hydrophilic polymer but is usually from 0.1 to 20% by weight to the amount of the hydrophilic polymer.

The mordant layers in this invention may further contain a light fading preventing agent, an optical brightening agent, an ultraviolet absorbent, etc.

As the light fading preventing agent, various known materials can be used. Practical examples of them are 2,6-t-butyl-p-cresol, 2,2′-methylenebis(4-methyl-6-t-butylphenol), 4,4′-thiobis(3-methyl-6-t-butylphenol), etc.

Practical examples of the ultraviolet absorbent are 2-(3′,5′-di-t-amyl-2′-hydroxyphenyl)benzotriazole, 2-(2′-hydroxy-3′,5′-di-t-butylphenyl)-5-chlorobenzotriazole, 2-(3′,5′-di-t-butyl-2-hydroxyphenyl)benzotriazole, 2-(2′-hydroxy-5′-methylphenyl)benzotriazole, 2-(hydroxy-5-t-butylphenyl)benzotriazole, 2-hydroxy-4-methoxybenzophenone, 2,2′-dihydroxy-4-methoxybenzophenone, 2-hydroxy-4-methoxy-2′-carboxybenzophenone, 2-hydroxy-4-n-octoxybenzophenone, 2,4-dihydroxybenzophenone, 2-ethylhexyl-2-cyano-3,3′-diphenyl acrylate, p-octylphenyl salicylate, 2,4-di-t-butylphenyl-3,5-di-t-butyl-4-hydroxybenzoate, etc.

As the optical brightening agents, there are used various known compounds such as stilbenes, cumalins, carbostyryls, diphenylpyrazolines, naphthalimides, and arylazolyls. As practical examples, there are such commercially available materials as Whitefluor B and Whitephore PCN (trade names, made by Sumitomo Chemical Co., Ltd.); Hakkol PY-1800, Hakkol PY-2000, and Hakkol PY-B (trade names, made by Showa Kagaku K.K.); Kayalight B and Kayalight OS (trade names, made by Nippon Kayaku Co., Ltd.); Hiblight 1001 (trade name, made by Dainichiseika Color & Chemicals Mfg. Co., Ltd.); Uvitex OB (trade name, made by Ciba-Geigy); and Mikephore ETN (trade name, made by Mitusi Toatsu Chemical, Inc.).

The cationic polymer latexes of this invention may be used solely or as a mixture of them.

The mordant layer of this invention is formed by coating a support with the above-described components using water or a mixture of water and a small amount of the water-miscible organic solvent such as methanol, ethanol, acetone, etc., by a conventional coating system followed by drying.

Conventionally known various supports can be used in this invention. For example, there are papers, baryta-coated papers, papers laminated with a thermoplastic polymer such as polyethylene, polystyrene films, polyester films such as polyethylene terephthalate films, etc., cellulose films, cellulose derivative films such as cellulose acetate films, cellulose propionate films, etc., polycarbonate films, glass sheets, etc.

The mordant layers of this invention are particularly effectively used as mordant layers for color diffusion transfer photography. Color diffusion transfer photograhic system is already widely known and the technical content are disclosed in, for example, U.S. Pat. No. 2,983,605, 3,415,644, 3,415,645, 3,415,646, 3,578,540, 3,573,043, 3,615,421, 3,594,164, 3,594,165, 3,620,724 and 3,635,707 and British Pat. Nos. 1,269,805 and 1,330,524.

More preferably, the mordant layers of this invention show particularly excellent effect in case of use for a laminated integral type color diffusion transfer photographic element comprising a support having formed thereon a dye image-receiving layer and at least one photosensitive silver halide emulsion layer having associated therewith a dye image-providing material.

A laminated integral type color diffusion transfer photographic film unit is widely known in the field of the art and is disclosed in, for example, U.S. Pat. Nos. 2,983,605, 3,415,644, 3,415,645, 3,415,646, 3,578,540, 3,573,043, 3,615,421, 3,594,164, 3,594,165, 3,620,724, 3,635,707, and 3,993,486, British Pat. Nos. 1,269,805 and 1,330,524, Japanese Patent Publication Nos. 21660/74 and 21661/74, Belgian Pat. Nos. 757,959 and 757,960, and West German Pat. No. 2,019,430.

For example, Belgian Pat. No. 757,960 discloses a photographic film unit wherein a photosensitive sheet having an image-receiving layer, a substantially opaque light-reflecting layer (e.g., a titanium dioxide-containing layer and a carbon black layer), and at least one photosensitive silver halide emulsion layer having associated therewith a dye image-providing material and an opaque cover sheet (having associated therein a neutralizing system) are fixed to a transparent support at one edge. After image-exposing the photosensitive sheet, the cover sheet and the photosensitive sheet are superposed in face-to-face relation, a processing composition is spread between both sheets to perform development processing in the light, and a color image transferred into the image-receiving layer is viewed through the transparent support.

Belgian Pat. No. 757,959 discloses a photographic film unit similar to that in above-described Belgian Pat. No. 757,960 except that a transparent cover sheet is used and the cover sheet and a photosensitive sheet are adhered at three edges. After image-exposing the photosensitive sheet through the transparent cover sheet, a developing composition containing an opacifying agent is distributed therebetween through another free edge to perform the development in the light and the color image transferred to the image-receiving layer is viewed through the transparent support.

Other materials used for color diffusion transfer photographic systems in this invention will be explained below.

A silver halide emulsion used in this invention is a hydrophilic colloidal dispersion of silver chloride, silver bromide, silver chlorobromide, silver iodobromide, silver chloroiodobromide or a mixture of them, and the halogen composition is selected according to the using purpose and processing conditions. The grain size of the silver halide used may be ordinary grain size or fine grain size, but those having a mean grain size in the range of from about 0.1 micron to about 2 microns are preferable. Furthermore, it is generally desirable that the silver halide have a uniform grain size distribution. The crystal form of the silver halide grain used may be a cubic system, an octahedron system or a mixed crystal system. These silver halide emulsions may be prepared by conventional methods as described in, for example, P. Glafkides, *Chimie Photographique,* 2nd Edition, Chapters 18–23, 1957, Paul Montel, Paris.

It is desirable that the silver halide emulsions used in this invention have been chemically sensitized by a natural sensitizer containing in gelatin; a sulfur sensitizer such as sodium thiosulfate or N,N,N'-triethylthiourea; a gold sensitizer such as a thiocyanate complex salt of monovalent gold, a thiosulfate complex salt of monovalent gold, etc.; or a reduction sensitizer such as stannous chloride, hexamethylenetetramine, etc., in combination with heat treatment.

In this invention silver halide emulsions of the type that a latent image is liable to form on the surfaces of the grains may be used, but it is preferred to use the internal latent image forming type direct reversal silver halide emulsions as described in, for example, U.S. Pat. Nos. 2,497,875, 2,588,982, 2,456,953, 3,761,276, 3,206,313, 3,317,322, 3,761,266, 3,850,637, 3,923,513, 3,736,140, 3,761,267 and 3,854,949.

The silver halide emulsions used in this invention can be stabilized using conventional stabilizers. Moreover, the silver halide emulsions used in this invention may contain a sensitizing compound such as a polyethylene oxide compound.

If desired, the silver halide emulsions used in this invention may be subjected to spectral sensitization. Examples of useful spectral sensitizers are cyanines, merocyanines, holopolar cyanines, styryls, hemicyanines, oxanoles, hemioxanoles, etc. Practical examples of spectral sensitizers are described in, for example, P. Glafkides, *Chimie Photographique,* 2nd Edition, Chapters 35–41, (1957) and F. M. Hamer, *The Cyanine and Related Compounds,* Interscience. In particular, cyanines wherein the nitrogen atom of the basic heterocyclic ring has been substituted by an aliphatic group (e.g., an alkyl group) having hydroxy group, carboxy group, or sulfo group as described in, for example, U.S. Pat. Nos. 2,503,776, 3,459,553 and 3,177,210 are useful.

Examples of dye image-providing materials for diffusion transfer photographic use in combination with the silver halide emulsions in this invention are described in, for example, U.S. Pat. Nos. 3,227,551, 3,227,554, 3,443,939, 3,443,940, 3,658,524, 3,698,897, 3,725,062, 3,728,113, 3,751,406, 3,929,760, 3,931,144 and 3,932,381, British Pat. Nos. 840,731, 904,364, and 1,038,331, West German Patent Application (OLS) Nos. 1,930,215, 2,214,381, 2,228,361, 2,242,762, 2,317,134, 2,402,900, 2,406,626, 2,406,653, Japanese Patent Application (OPI) Nos. 114424/74, 126332/74, 33826/73, 126331/74, 115528/75, 113624/76, 104343/76, 8827/77, 106727/77, 114930/76 and 23628/78 and published Japanese Patent Application (OPI) Nos. 143328/78 and 149328/78, 8627/79 and 65034/79. In these materials, it is particularly preferred to use the dye image providing materials which are initially non-diffusible but cleave after causing the oxidation reduction reaction with the oxidation product of a color developing agent to release diffusible dyes (hereinafter referred to as DRR compounds).

Practical examples of the DRR compounds are, in addition to those described in the above-described patent specification, magenta dye image-forming materials such as 1-hydroxy-2-tetramethylenesulfamoyl-4-[3'-methyl-4'-(2''-hydroxy-4''-methyl-5''-hexadecyloxyphenylsulfamoyl)phenylazo]naphthalene; yellow dye image-forming materials such as 1-phenyl-3-cyano-4-{3'-[2''-hydroxy-4''-methyl-5''-(2''',4'''-di-t-pentylphenoxyacetamino)phenylsulfamoyl]phenylazo}-5-pyrazolone, etc.

When DRR compounds are used in this invention, any silver halide developing agents which can cross oxidize these compounds may be used in this invention. These developing agents may be incorporated in an alkaline processing composition (processing element) or in a proper layer of a photosensitive element.

Typical examples of the developing agent used in this invention are hydroquinone, an aminophenol (e.g., N-methylaminophenol), 1-phenyl-3-pyrazolidone, 1-phenyl-4,4-dimethyl-3-pyrazolidone, 1-phenyl-4-methyl-4-oxymethyl-3-pyrazolidone, N,N-diethyl-p-phenylenediamine, 3-methyl-N,N-diethyl-p-phenylenediamine, 3-methoxy-N-ethoxy-p-phenylenediamine, etc.

In the above-described developing agents, black and white developing agents having a property of reducing the formation of stain in image-receiving layers (mordant layers) are particularly preferred.

At the practice of this invention, when a so-called ordinary type silver halide emulsion which causes development in proportion to the amount of light exposure in case of using DRR compounds, a negative image is formed as the transfer image and a positive image as a remaining image. On the other hand, when a so-called direct reversal silver halide emulsion (e.g., an internal latent image type silver halide emulsion or a solarization type silver halide emulsion) which is developed at unexposed regions is used, a positive image is obtained in the image-receiving layer of a film unit.

Useful solarization type silver halide emulsions are described in, for example, Mees, *The Theory of the Photographic Process*, pp. 261–297 (1942), Macmillan Co., New York. The preparation methods of these silver halide emulsions are described, for example, in British Pat. Nos. 443,245 and 462,730 and U.S. Pat. Nos. 2,005,837, 2,541,472, 3,367,778, 3,501,305, 3,501,306 and 3,501,307.

Internal latent image type direct positive silver halide emulsions used in this invention are also described in the specifications of the U.S. Patents described above.

In case of using the direct reversal photographic silver halide emulsions of this invention, a direct positive image is obtained by developing the silver halide emulsion layers, after image-exposure, in the presence of a fogging agent or by overall exposure (the exposure may be short time exposure shorter than $10^{-2}$ second at high illumination or long exposure at low illumination) of the silver halide emulsion layers, after image exposure, during developing the emulsion layers as described in Knott and Stevens, U.S. Pat. No. 2,456,953. However, the use of a fogging agent is preferred in order that the extent of fogging can be easily controlled. The fogging agent may be incorporated in photosensitive materials or in developers but the former case is preferred. Typical examples of the fogging agent of this type are hydrazines described in U.S. Pat. Nos. 2,588,982 and 2,568,785; hydrazide and hydrazone described in U.S. Pat. No. 3,227,552; quaternary salt compounds described in British Pat. No. 1,283,835, Japanese Patent Publication No. 38164/74, and U.S. Pat. Nos. 3,734,738, 3,719,494 and 3,615,615; and acylhydrazinophenylthiourea series compounds described in German Patent Application (OLS) No. 2,635,316.

The amount of the fogging agent used can be widely changed in accordance with the desired result. When a fogging agent is incorporated in a developer, the amount is generally from about 0.05 to 5 g, and preferably 0.1 to 1 g per liter of a developer. When a fogging agent is incorporated in a layer of a photosensitive material, it is effective for the purpose to make the fogging agent non-diffusible. As a means for rendering the fogging agent non-diffusible, it is effective to link a ballast group usually used for couplers to the fogging agent.

Furthermore, transfer positive images can be also obtained by the DIR (development inhibitor releasing) reversal silver halide emulsion system as described in U.S. Pat. Nos. 3,227,551, 3,227,554 and 3,364,022 or the reversal silver halide emulsion system by dissolution physical development as described in British Pat. No. 904,364.

A series of processes for obtaining color diffusion transfer images is described in, for example, U.S. Pat. Nos. 3,227,550 and 3,227,552 and British Pat. No. 1,330,524.

The typical color developing agents in case of using diffusible dye-releasing couplers in this invention are the para-phenylenediamine derivatives described in, for example, U.S. Pat. Nos. 3,227,552, 2,559,643 and 3,813,244. Furthermore, the p-aminophenol derivatives as described in Japanese Patent Application (OPI) No. 26134/73 are advantageously used. Such a color developing agent is preferably incorporated in an alkaline processing composition for development contained in rupturable containers. A color developing agent may be incorporated in an additional layer formed in a negative image side of a film unit or may be incorporated in a silver halide emulsion layer.

The processing composition used in this invention is a liquid composition containing processing components necessary for developing silver halide emulsions and forming diffusion transfer dye images. The solvent is mainly water but the liquid composition may, as the case may be, contain a hydrophilic solvent such as methanol, methyl cellosolve, etc. The processing composition contains an alkali in an amount sufficient for keeping a necessary pH for causing the development of silver halide emulsion layers and neutralizing acids (e.g., hydrohalogenic acids such as hydrobromic acid, etc., and carboxylic acids such as acetic acid, etc.) formed during the steps of forming dye images. Examples of the alkali used for the purpose are alkali metal or alkaline earth metal salts and amines such as lithium hydroxide, sodium hydroxide, potassium hydroxide, a dispersion of calcium hydroxide, tetramethylammonium hydroxide, sodium carbonate, sodium tertiary phosphate, diethylamine, etc., and it is preferred that the processing composition contains an alkali hydroxide at a concentration of providing a pH of higher than about 11, particularly higher than 13 at room temperature. More preferably, the processing composition contains a hydrophilic polymer such as high molecular weight polyvinyl alcohol, hydroxyethyl cellulose, sodium carboxymethyl cellulose, etc. These polymers not only impart to the processing composition a viscosity of higher than 1 poise, preferably from 500 to 1,000 poises to facilitate uniform spreading of the processing composition at development but also form a non-fluidable film when the processing composition is concentrated by transferring of the aqueous medium into photosensitive element and image-receiving element during processing to assist unitizing of film unit after processing. The polymer film also contributes to prevent the deterioration of dye images by restraining coloring components from further transferring into the image-receiving layer after substantially finishing the formation of diffusion transfer dye images.

It is advantageous that the processing composition further contains a light absorbing material for preventing silver halide emulsions from being fogged by external light during processing, such as titanium dioxide, carbon black, a pH indicator as well as the desensitizer as described in U.S. Pat. No. 3,579,333. Moreover, the processing composition may further contain a development inhibitor such as benzotriazole.

It is preferred that the processing composition described above be used in a rupturable container as described in U.S. Pat. Nos. 2,543,181, 2,643,886, 2,653,732, 2,723,051, 3,056,491, 3,056,492, 3,152,515, etc.

Then, the invention will further be explained by the following practical examples for the production method of the seed polymerized latex mordants and the color diffusion transfer photographic elements using the latex.

SYNTHESIS EXAMPLE 1

Synthesis of Compound (2)

A one liter four neck flask was placed on an oil bath and a stirrer, a nitrogen inlet pipe, a thermometer and a reflux condenser were installed. In the flask were placed 380 ml of distilled water and 2 g of polyoxyethylene nonylphenyl ether (the polymerization degree of polyoxyethylene about 30) followed by stirring. After dissolving the polymer, 6 g of styrene was added to the solution and the mixture was stirred to form an emulsion. Then, after passing therethrough 100 ml/min of nitrogen and setting the bath temperature to 70° C. in inside temperature, 20 g of an aqueous solution of 0.06 g of 2,2'-azobis(2-amidinopropane) 2-hydrochloride was added to the emulsion. After 2 to 3 minutes since the initiation of the polymerization, the white emulsion became blue and transparent. After 30 minutes, a monomer emulsion prepared by mixing 114 g of N-vinylbenzyl trihexylammonium chloride (m-, p-mixture, m.p. 107°–108.5° C.), 280 ml of distilled water, 2 g of polyoxyethylene nonylphenyl ether (polymerization degree of polyoxyethylene: about 30), and 0.18 g of 2,2'-azobis(2-amidinopropane) 2-hydrochloride at normal temperature began to be added dropwise to the solution. In this case, the monomer emulsion was stirred in a one liter beaker by means of a magnetic stirrer and the dropping rate was so set that 396.18 g of the emulsion was added dropwise over a 3 hour period. After performing the polymerization with the addition of the emulsion for 3 hours, the mixture was ripened to finish the reaction. The reaction mixture was filtered by means of a 200 mesh screen to provide 799.9 g of a desired product. The mean particle size of the product measured by means of an electron microscope was 0.08 micron, the concentration was 15.0% by weight, and the pH was 3.30.

SYNTHESIS EXAMPLE 2

Synthesis of Compound (1)

By following the same procedure as in Synthesis Example 1 except that 6 g of n-butyl acrylate was used in place of 6 g of styrene, 794.3 g of the desired product was obtained. The concentration was 15.1% by weight, the pH was 3.25, and the mean particle size was 0.09 micron.

SYNTHESIS EXAMPLE 3

Synthesis of Compound (6)

By following the same procedure as in Synthesis Example 1 except that 114 g of N-vinylbenzyl N,N-dimethyl p-chlorobenzylammonium chloride (m-, p-mixture, m.p. 145° C.) was used in place of N-vinylbenzyl trihexylammonium chloride, 791.3 g of the desired product was obtained. The concentration was 15.0% by weight, the pH was 3.20, and the mean particle size was 0.09 micron.

As indicated above, particle sizes of the polymer latexes by the present invention are very fine.

For the sake of reference, synthesis methods (comparison examples) for conventional polymer latexes are shown below.

COMPARISON EXAMPLE 1

Synthesis of Comparison Compound (A)

In the apparatus as in Synthesis Example 1 were placed 380 ml of distilled water, 2 g of polyoxyethylene nonylphenyl ether (the polymerization degree of polyoxyethylene: about 30), and 6 g of acid-treated gelatin and the mixture was heated to 60° C. with stirring to dissolve them. Then, 20 g of N-vinylbenzyl trihexylammonium chloride was added to the solution and after passing therethrough 100 ml/min of nitrogen while emulsifying the mixture and setting the bath temperature to 70° C. in inside temperature, 10 g of an aqueous solution of 0.06 g of 2,2'-azobis(2-amidinopropane) 2-hydrochloride was added to the solution. After 30 minutes, a monomer emulsion prepared by mixing 100 g of N-vinylbenzyl trihexylammonium chloride, 280 ml of distilled water, 2 g of polyoxyethylene nonylphenyl ether (the polymerization degree of polyoxyethylene: about 30), and 0.18 g of 2,2'-azobis(2-amidinopropane) 2-hydrochloride was added dropwise to the emulsion over a period of 3 hours as in Synthesis Example 1 and thereafter the polymerization was performed for 3 hours to provide 752.3 g of a single polymer latex. The concentration was 16.9% by weight, the pH 4.83, and the mean particle size 0.17 micron.

COMPARISON EXAMPLE 2

Synthesis of Comparison Compound (B)

By following the same procedure as in Comparison Example 1, except that 6 g of acid-treated gelatin was not used, 0.6 g of styrene and 11.4 g of N-vinylbenzyl trihexylammonium chloride was used in place of 20 g of N-vinylbenzyl trihexylammonium chloride, and 5.4 g of styrene and 102.6 g of N-vinylbenzyl trihexylammonium chloride were used in place of 100 g of N-vinylbenzyl trihexylammonium chloride in the monomer emulsion, 797.0 g of a copolymer latex was obtained. The concentration was 15.4% by weight, the pH 3.31, and the mean particle size 0.15 micron.

The mean particle size of the latexes for mordant layers in this invention is preferably from 0.02 to 0.10 micron (the mean particle size can be determined by measuring the size of particles by means of an electromicroscopic photograph and averaging these values).

EXAMPLE 1

Transparency Test of Mordant Layer

A mixture having the following composition was coated on a polyester base (150 microns thick). The coverage of the mordant was 3.4 g/m$^2$ and that of gelatin was 3.0 g/m$^2$. (Mordant Layer Sample 1).

| | |
|---|---|
| Gelatin (10% by weight aq. soln.) | 72 g |
| Water | 101 ml |
| Compound (1) of this invention (the latex prepared in Synthesis Example 2) | 55.1 g |
| Formalin (2% by weight aq. soln.) | 12 ml |

Furthermore, the same procedure as above was followed using Compound (2) or (6) of this invention or Comparison Compound (A) or (B) while controlling the addition amount thereof so that the coverage of it became same as above to provide Mordant Layer Samples 2 and 3 and Comparison Samples A and B. The haze of the dry film and the haze of the film immersed in water for 10 minutes were evaluated on each sample thus coated by the light transmission density ($D_{460}$) at 460 nm measured by means of a spectrophotometer. The dry film was measured with air as reference and water-wetted film was measured with water as reference. The results are shown in Table 1.

TABLE 1

| | | Haze of Film | |
|---|---|---|---|
| Sample | Mordant | $D_{460}$ (dry film) | $D_{460}$ (wet film) |
| Mordant Layer Sample 1 | Compound (1) | 0.105 | 0.068 |
| Mordant Layer Sample 2 | Compound (2) | 0.105 | 0.065 |
| Mordant Layer Sample 3 | Compound (6) | 0.105 | 0.066 |
| Comparison Mordant Layer Sample A | Comparison A | 0.128 | 0.238 |
| Comparison Mordant Layer Sample B | Comparison B | 0.112 | 0.120 |

As is clear from the above results, the mordant layers of this invention were less in haze and are excellent in transparency.

EXAMPLE 2

Transfer Test for Mordant

Each of five kinds of the mordant layer coated films as in Example 1 was coated with the light-reflecting layer having the following composition and dried. (Light-Reflecting Layer Coated Samples 1, 2, and 3 and Comparison Samples A and B). ($TiO_2$ 20 g/m$^2$, gelatin 0.4 g/m$^2$).

| | |
|---|---|
| $TiO_2$ dispersion | 154 g |
| Aqueous gelatin solution (10 wt %) | 17.2 g |
| Water | 74 ml |
| Sodium dioctylsulfosuccinate (5 wt % aq. soln.) | 1.0 ml |
| $CH_2{=}CHSO_2CH_2CH(OH)CH_2SO_2CH{=}CH_2$ (2 wt% aq. soln.) | 2.0 ml |

The $TiO_2$ dispersion was prepared by dispersing the following components by means of a commercially available dispersing machine, employing the following components.

| | |
|---|---|
| $TiO_2$ (Typake R 960, registered trademark of E.I. Du Pont de Nemours and Company) | 50 g |
| Water | 30 ml |
| Sodium salt of carboxymethyl cellulose | 0.4 g |
| Gelatin | 0.3 g |

A part of the coated sample thus obtained was allowed to stand for 3 days at 50° C. and 80% RH. Another coated sample was also allowed to stand at room temperature. They were cut into sample pieces, immersed in a dye bath having the following composition for 5 minutes, washed with water for 10 minutes, and dried.

Dyeing Bath Composition

Magenta dye of the formula

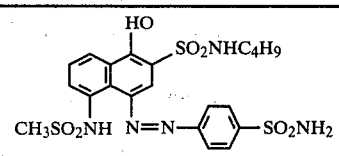

0.027 g 0.1N NaOH 100 ml

The optical density of each of the dyed samples was measured using Macbeth reflection densitometer. In this case the magenta density ($D_M{}^G$) at the polyester support side was measured to evaluate mordanted amount of the dye and also the magenta density ($D_{TiO_2}{}^G$) at the light-reflecting layer side was measured to evaluate the relative comparison of the transferred amount of the mordant. If the mordant transfers from a mordant layer into the adjacent light-reflecting layer, the mordant mordants the dye in the light-reflecting layer, thereby the light-reflecting layer is dyed or colored. As the $D_{TiO_2}{}^G$ at the light-reflecting layer side is large, the transferred amount of the mordant is larger. The results are shown in Table 2.

TABLE 2

| | Relative Comparison of Transferred Amount | | | | | |
|---|---|---|---|---|---|---|
| | Light-Reflecting Layer Coated Sample Used | | Dyeing Density | | | |
| | | | Room Temp. | | 50° C., 80% RH, 3 Days | |
| No. | for Dyeing | Mordant | $D_M^G$ | $D_{TiO_2}^G$ | $D_M^G$ | $D_{TiO_2}^G$ |
| 1 | Light-Reflecting Layer Coated Sample 1 | Compound (1) | 1.43 | 0.07 | 1.38 | 0.08 |
| 2 | Light-Reflecting Layer Coated Sample 2 | Compound (2) | 1.44 | 0.08 | 1.47 | 0.08 |
| 3 | Light-Reflecting Layer Coated Sample 3 | Compound (6) | 1.48 | 0.09 | 1.45 | 0.09 |
| 4 | Comparison Sample A | Comparison Compound A | 1.40 | 0.15 | 1.40 | 0.25 |
| 5 | Comparison Sample B | Comparison Compound B | 1.42 | 0.07 | 1.40 | 0.11 |

It is clear that in case of using the mordants of this invention, the amounts of the transferred components in the mordants are small. From the fact that $D_{TiO_2}{}^G$ is fairly smaller than $D_M{}^G$ on the above-described five samples and also $D_M{}^G$ is scarcely changed when the sample is forcibly aged at 50° C. and 80% RH for 3 days, it is assumed that the mordants are mostly nontransferable, and a very small part of the remaining monomers or low molecular weight oligomer components are transferred. Therefore, it is assumed that the compounds prepared according to the polymerization method of this invention contain very small amounts of such monomers and oligomer components.

EXAMPLE 3

Test in Laminated Type Color Diffusion Transfer Photographic Materials

Preparation of Photosensitive Sheet

Each of five kinds of the light-reflecting layer coated samples in Example 2 was successively coated with the following layers to provide Photosensitive Sheet Samples 1, 2, and 3, and Comparison Photosensitive Sheet Samples A and B.

(1) A light-shielding layer containing carbon black (2.7 g/m$^2$) and gelatin (2.7 g/m$^2$).

(2) A layer containing 0.50 g/m$^2$ of the cyan dye releasing redox compound having the following structure

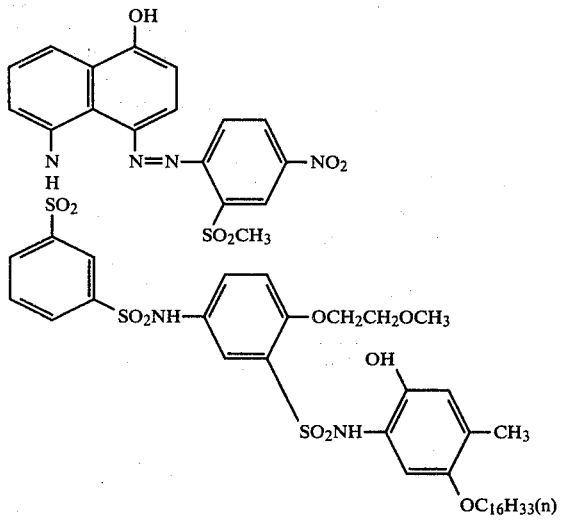

0.50 g/m$^2$ of N,N-diethyllaurylamide and 1.5 g/m$^2$ of gelatin.

(3) A layer containing a red-sensitive internal latent image type silver halide emulsion (1.1 g/m$^2$ of gelatin and 1.4 g/m$^2$ of silver), 0.015 g/m$^2$ of 1-acetyl-2-[4-(2,4-di-t-pentylphenoxyacetamido)phenyl]hydrazine, and 0.067 g/m$^2$ of sodium 2-pentadecylhydroquinone-5-sulfonate.

(4) A color mixing preventing agent-containing layer containing 1.0 g/m$^2$ of gelatin, 1.0 g/m$^2$ of a 2,5-di-t-pentadecylhydroquinone eutectic mixture, and 0.25 g/m$^2$ of a polyvinylpyrrolidone-vinyl acetate copolymer (7:3 by mol ratio).

(5) A layer containing 0.80 g/m$^2$ of the magenta dye releasing redox compound having the following structure

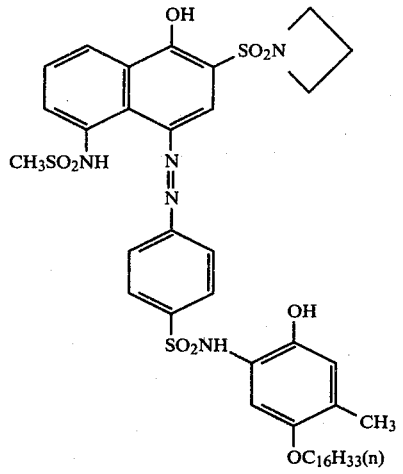

0.20 g/m$^2$ of N,N-diethyllaurylamide, and 1.2 g/m$^2$ of gelatin.

(6) A layer containing a green-sensitive internal latent image type silver iodobromide emulsion (1.1 g/m$^2$ of gelatin and 1.4 g/m$^2$ of silver), 0.015 g/m$^2$ of 1-acetyl-2-[4-(2,4-di-t-pentylphenoxyacetamido)phenyl]hydrazine, and 0.067 g/m$^2$ of sodium 2-pentadecylhydroquinone-5-sulfonate.

(7) A color mixing preventing agent-containing layer containing 1.0 g/m$^2$ of gelatin, 1.0 g/m$^2$ of a 2,5-di-t-pentadecylhydroquinone eutectic mixture, and 0.25 g/m$^2$ of a polyvinyl pyrrolidone-vinyl acetate copolymer (7:3 by mol ratio).

(8) A layer containing 0.45 g/m$^2$ of the yellow dye releasing redox compound having the following structure I

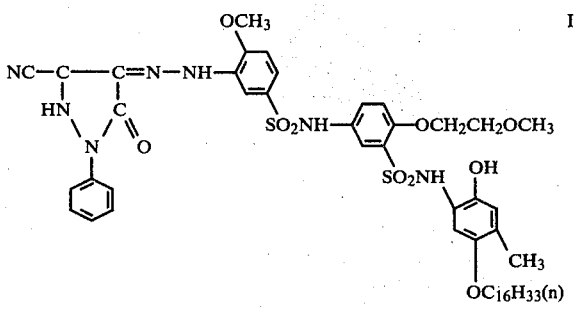

I 0.55 g/m$^2$ of the yellow dye releasing redox compound having the following structure II

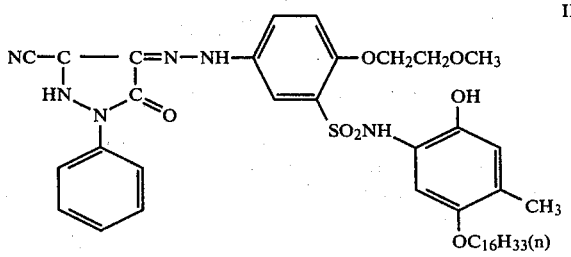

II 0.25 g/m$^2$ of N,N-diethyllaurylamide, and 1.0 g/m$^2$ of gelatin.

(9) A layer containing a blue-sensitive internal latent image type silver iodobromide emulsion (1.1 g/m$^2$ of gelatin and 1.4 g/m$^2$ of silver), 0.015 g/m$^2$ of 1-acetyl-2-[4-(2,4-di-t-pentylphenoxyacetamido)phenyl]hydrazine, and 0.067 g/m$^2$ of sodium 2-pentadecylhydroquinone-5-sulfonate.

(10) A protective layer containing 1.3 g/m$^2$ of gelatin, 0.9 g/m$^2$ of a latex of polyethylacryl acrylate, 0.5 g/m$^2$ of tinubin, and 0.026 g/m$^2$ of a hardening agent, triacryloyl perhydrotriazine.

Composition of Viscous Processing Solution

A processing solution having the following composition was prepared and 1.1 ml of the solution was packed in each rupturable container under a nitrogen atmosphere.

| | |
|---|---|
| Water | 820 ml |
| 1N $H_2SO_4$ | 5 ml |
| Hydroxyethyl cellulose | 60 g |
| 4-Hydroxymethyl-4-methyl-1-phenyl-3-pyrazolidone | 5 g |
| 5-Methylbenzotriazole | 2 g |
| t-Butylhydroquinone | 0.4 g |
| Sodium sulfite (anhydrous) | 2 g |
| Carbon black | 150 g |
| Sodium hydroxide | 30 g |

Cover Sheet

A biaxially elongated transparent polyester film of 100 micron thick was successively coated with the following layers and dried.

(1) A layer containing 22 g/m$^2$ of a 80:20 (by weight ratio) acrylic acid-butyl acrylate copolymer (showing a viscosity of about 4,000 cp in 25% by weight water-acetone mixed solution) and 0.44 g/m$^2$ of 1,4-bis(2,3'-epoxypropoxy)butane.

(2) A layer containing 3.8 g/m$^2$ of acetyl cellulose (39.4 g of acetyl group is formed by hydrolyzing 100 g of the acetyl cellulose), 0.2 g/m$^2$ of poly(styrene-comaleic anhydride) (styrene:maleic anhydride=about 60:40, molecular weight of about 50,000), and 0.115 g/m$^2$ of 5-($\beta$-cyanoethylthio)-1-phenyl-tetrazole.

(3) A layer containing 2.5 g/m$^2$ of a 85:12:3 (by weight ratio) copolymer latex of vinylidene chloride, methyl acrylate, and acrylic acid and 0.05 g/m$^2$ of a polymethyl methacrylate latex having particle sizes of 1 to 3 microns.

After image-exposing each of the above-described Photosensitive Sheet Samples 1, 2, and 3, and Comparison Samples A and B, the cover sheet was superposed on the sample, the viscous processing solution was spread between them at a thickness of 80 microns, and after 1 hour, the density of the transferred dyes was measured by means of the reflection densitometer. The maximum densities of the yellow, magenta and cyan dye images ($D_{Max}^B$, $D_{Max}^G$, and $D_{Max}^R$) were shown in Table 3.

As is clear from Table 3, in Comparison Sample A, the formation of haze on the image was striking and the densities of the transferred dye images were low. In Comparison Sample B, the formation of haze was lower than that in Comparison Sample A but was clearly observed to reduce greatly the image quality.

On the other hand, Photosensitive Sheet Samples 1, 2, and 3 by the present invention have clear and good images.

TABLE 3

Transferred Density in Laminated Type Photosensitive Sheet

| No. | Sample | Mordant | Maximum Transferred Density $D_{MAX}^B$ | $D_{MAX}^G$ | $D_{MAX}^R$ |
|---|---|---|---|---|---|
| 1 | Photosensitive Sheet Sample 1 | Compound (1) | 1.72 | 2.08 | 1.82 |
| 2 | Photosensitive Sheet Sample 2 | Compound (2) | 1.78 | 2.10 | 1.82 |
| 3 | Photosensitive Sheet Sample 3 | Compound (6) | 1.78 | 2.10 | 1.82 |
| 4 | Comparison Sample A | Comparison Compound A | 1.18 | 1.55 | 1.45 |
| 5 | Comparison Sample B | Comparison Compound B | 1.62 | 1.88 | 1.72 |

Also, in Comparison Photosensitive Sheet Sample A, $D_{Max}^R$ was very low, which is considered to be partially caused by the partial transfer of the mordant used. Furthermore, when each sample was image-exposed after being forcibly aged for 3 days at 50° C. and 80% RH and developed by the same manner as above, $D_{Max}^R$ in Comparison Samples A and B was further reduced.

While the invention has been described in detail and with reference to specific embodiments thereof, it will be apparent to one skilled in the art that various changes and modifications can be made therein without departing from the spirit and scope thereof.

What is claimed is:

1. A color diffusion transfer photographic element including a support and a mordant layer comprising a cationic polymer latex which is prepared by emulsion-polymerizing a monomer represented by formula (I)

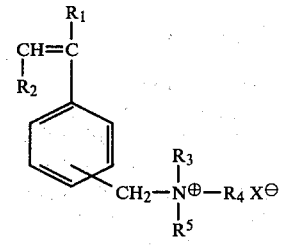

(I)

wherein $R_1$ and $R_2$ each represents hydrogen or an alkyl group having from 1 to 6 carbon atoms; $R_3$, $R_4$, and $R_5$ each can represent an alkyl group having from 1 to 20 carbon atoms, an aralkyl group having from 7 to 10 carbon atoms; or any two of $R_3$, $R_4$, and $R_5$ together can form a ring; and $X^\ominus$ represents an anion; as a shell component for a core component of dispersed particles of a polymer latex obtained by emulsion-polymerizing a water-insoluble ethylenically unsaturated monomer compound or ethylenically unsaturated monomer compounds other than the monomer of formula (I).

2. A color diffusion transfer photographic element as in claim 1, wherein $R_1$ and $R_2$ are hydrogen.

3. A color diffusion transfer photographic element as in claim 1 or 2, wherein $R_3$, $R_4$, and $R_5$ are alkyl groups, and the sum of the total number of carbon atoms thereof is at least 12.

4. A color diffusion transfer photographic element as in claim 1 or 2, wherein $R_3$, $R_4$, and $R_5$ are hexyl groups.

5. A color diffusion transfer photographic element as in claim 1, wherein the water-insoluble monomer from which the core component is formed is an acrylic acid ester, a methacrylic acid ester, or styrene.

6. A color diffusion transfer photographic element as in claim 5, wherein the monomer from which the core component is formed is styrene.

7. A color diffusion transfer photographic element as in claim 5, wherein the monomer from which the core component is formed is methyl methacrylate.

8. A color diffusion transfer photographic element as in claim 1, wherein the layer containing the cationic polymer latex contains gelatin.

9. A color diffusion transfer photosensitive sheet comprising a support having formed thereon the layer containing cationic polymer latex as in claim 1, a light-reflecting layer, and at least one photosensitive silver halide emulsion layer having associated therewith a dye image-providing material.

10. A color diffusion transfer image-receiving sheet comprising a transparent or opaque support having formed thereon a layer of cationic polymer latex as in claim 1.

11. A color diffusion transfer photographic element as in claim 1 or 2, wherein $R_3$, $R_4$, and $R_5$ are alkyl groups, and the sum of the total number of carbon atoms thereof is at least 15.

12. A color diffusion transfer photographic element as in claim 1, wherein the mean particle size of said cationic polymer latex is less than $0.1\mu$.

13. A color diffusion transfer photographic element as in claim 1 or 2, wherein the aralkyl group has 7 or 8 carbon atoms.

14. A color diffusion transfer photographic element as in claim 1 or 2, wherein said aralkyl group has a halogen atom as a substituent.

15. A color diffusion transfer photographic element as in claim 1 or 2, wherein said aralkyl group has a nitro group as a substituent.

16. A color diffusion transfer photographic element as in claim 1 or 2, wherein two of $R_3$, $R_4$, and $R_5$ together form a piperidine ring.

17. A color diffusion transfer photographic element as in claim 16, wherein said piperidine ring is substituted by an alkyl group having from 1 to 5 carbon atoms.

18. A color diffusion transfer photographic element as in claim 1 or 2, wherein at least one of $R_3$, $R_4$, and $R_5$ is an aralkyl group and the total number of carbon atoms of $R_3$, $R_4$, and $R_5$ is larger than 9.

19. A color diffusion transfer photographic element as in claim 1 or 2, wherein the molar ratio of core/shell is in the range of from 90/10 to 1/99.

20. A color diffusion transfer photographic element as in claim 19, wherein the molar ratio of core/shell is from 55/45 to 10/90.

21. A color diffusion transfer photographic element as in claim 19, wherein the molar ratio of core/shell is from 25/75 to 10/90.

22. A color diffusion transfer photographic element as in claim 1 or 2, wherein the shell component is obtained by emulsion polymerizing a water-insoluble monomer or monomers in the presence of a surface active agent in a concentration of from 0.1 to 10% by weight, based on the total weight of the monomers.

23. A color diffusion transfer photographic element as in claim 1 or 2, wherein the shell component is obtained by emulsion polymerizing a water-insoluble monomer or monomers in the presence of a surface active agent in a concentration of from 2 to 7% by weight, based on the total weight of the monomers.

24. A color diffusion transfer photographic element as in claim 1 or 2 wherein the shell component is obtained by emulsion polymerizing a water-insoluble monomer or monomers in the presence of a nonionic surface active agent.

25. A color diffusion transfer photographic element as in claim 24 wherein the concentration of the nonionic surface active agent is from 0.1 to 10% by weight based on the total weight of the monomers.

26. A color diffusion transfer photographic element as in claim 1 or 2 wherein the shell component is obtained by emulsion polymerizing a water-insoluble monomer or monomers in the presence of 2,2'-azobis(2-amidinopropane) di-hydrochloride as a polymerization initiator.

27. A color diffusion transfer photographic element as in claim 26 wherein the amount of 2,2'-azobis(2-amidinopropane) di-hydrochloride is form 0.01 to 0.5% by weight to the total amount of the monomers.

28. A laminated integral type color diffusion transfer photographic element comprising a support and a mordant layer comprising a cationic polymer latex which is prepared by emulsion-polymerizing a monomer represented by formula (I)

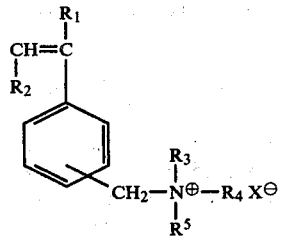

(I)

wherein $R_1$ and $R_2$ each represents hydrogen or an alkyl group having from 1 to 6 carbon atoms; $R_3$, $R_4$ and $R_5$ each can represent an alkyl group having from 1 to 20 carbon atoms, an aralkyl group having from 7 to 10 carbon atoms; or any two of $R_3$, $R_4$ and $R_5$ together can form a ring; and $X^{\ominus}$ represents an anion; as a shell component for a core component of dispersed particles of a polymer latex obtained by emulsion-polymerizing a water-insoluble ethylenically unsaturated monomer compound or ethylenically unsaturated monomer compounds other than the monomer of formula (I).

* * * * *